United States Patent [19]

Forrest

[11] Patent Number: 4,848,191

[45] Date of Patent: Jul. 18, 1989

[54] STOPPER REMOVAL APPARATUS

[76] Inventor: Stuart E. Forrest, 494 Ash, Winnetka, Ill. 60093

[21] Appl. No.: 302,471

[22] Filed: Jan. 26, 1989

Related U.S. Application Data

[63] Continuation-in-part of Ser. No. 07/152,988 Feb. 8, 1988, abandoned.

[51] Int. Cl.[4] ..... B67B 7/02

[52] U.S. Cl. ..... 81/3.44

[58] Field of Search ..... 81/3.44, 3.4, 3.07, 81/3.48, 3.49

[56] References Cited

U.S. PATENT DOCUMENTS 2,495,308 1/1950 Amigone ..... 81/3.44

FOREIGN PATENT DOCUMENTS 1068568 2/1954 France ..... 81/3.44

71129 12/1927 Sweden ..... 81/3.44

9768 of 1904 United Kingdom ..... 81/3.44

*Primary Examiner*—Roscoe V. Parker

*Attorney, Agent, or Firm*—McAndrews, Held & Malloy, Ltd.

[57] ABSTRACT

A stopper removal apparatus for safely and easily removing a cork and other plastic types of stoppers from a glass bottle containing a beverage under pressure. The apparatus comprises two molded curved members coupled together at a fulcrum point between their ends and operated in a scissor-like manner. Each molded member has an integral jaw adjacent to its lower end for substantially encircling the stopper. The jaws include a plurality of integral evenly spaced, sharply pointed prongs or tines that deeply penetrate the stopper and thus provide a secure, non-slip grip so that the stopper may be easily and safely removed without breaking or becoming a projectile capable of causing injury.

5 Claims, 2 Drawing Sheets

FIG. 1
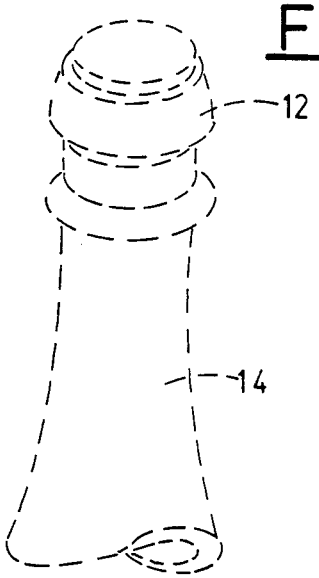
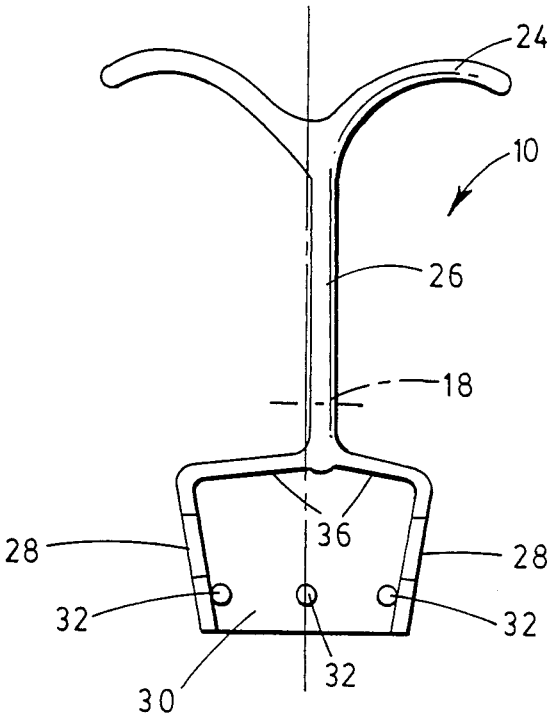
FIG. 2
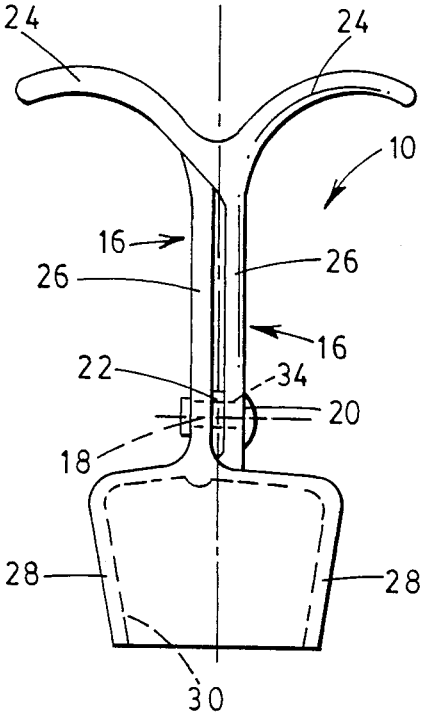
FIG. 3

FIG. 4
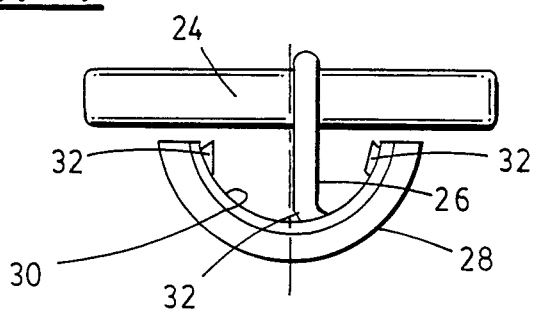
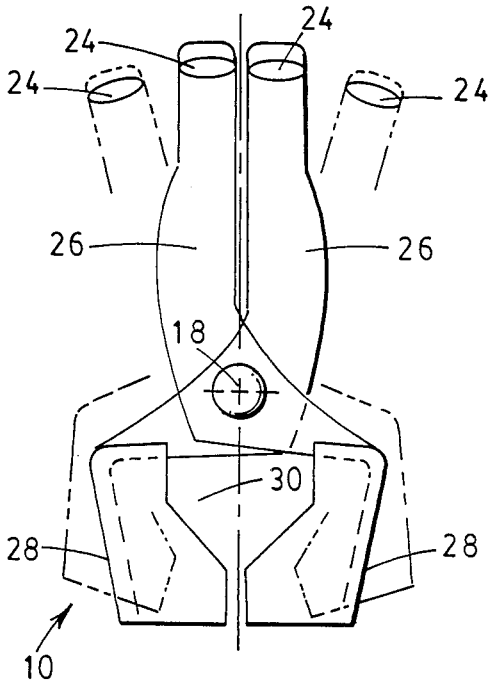
FIG. 5
FIG. 6
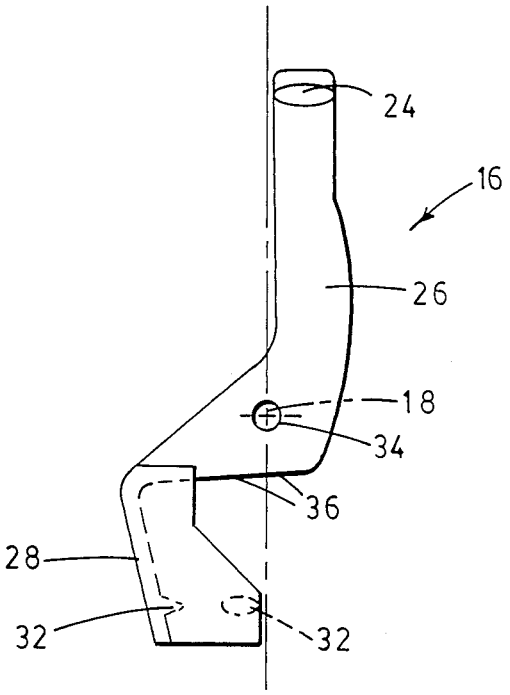

STOPPER REMOVAL APPARATUS

RELATED APPLICATION

This is a continuation in part of my co-pending application Ser. No. 07/152,988 filed Feb. 8, 1988 now abandoned.

BACKGROUND OF THE INVENTION

The present invention relates to stopper removal apparatus for removing a cork or plastic stopper of the type used as a closure for glass bottles containing beverages under pressure, such as champagne, sparkling wines and the like.

In the past, it was frequently frustrating and potentially dangerous to remove a cork or plastic stopper from a glass bottle containing a beverage under pressure. Such stoppers are initially coupled to the bottle by a wire mesh or net that inhibits the premature removal of the stopper from the bottle. To open such bottles, the retaining wire and or mesh first had to be completely removed from the bottle. Then the stopper had to be pushed up out of the bottle. Generally this was done in the past by grasping the neck of the bottle in both hands, and pressing upwardly, with one or both thumbs, on the part of the stopper that normally projects above the top of the bottle. This method tends to open the bottle too quickly, that is, with a "pop". This is deteriorative of the quality of the beverage in that it causes the carbonated gases, the bubbles, in the beverage to needlessly expand too rapidly. Additionally this method tends to be dangerous. The stopper may become an uncontrolled "flying" projectile that can cause serious injury to anyone or anything in the immediate area and that may quickly turn a festive occasion into a sad one. The exit velocity of such stoppers are frequently such that the stopper can strike a person sitting or standing nearby, for example across the table, before he or she can even blink an eye. Also this method frequently results in beverage spillage with a concomitant mess.

Another common method of removing such a stopper is to cover the stopper with a towel or other such cloth and then twist the stopper in one direction or the other so as to allow the pressure inside the bottle to force the stopper out. This method is potentially dangerous and troublesome. The stopper can slip out from beneath the towel and become a projectile. The beverage may spill or gush out. Similarly the stopper, and particularly a cork, may break, due to the twisting force or torque applied, leaving part of it in the towel and part in the neck of the bottle. Due to the pressure in the bottle, removal of the broken part from the neck of the bottle presents even a more serious problem and danger leading some to discard the bottle.

Still another method that has been proposed is to use a pliers type device, with long handles, to twist the stopper out of the bottle. An example of such a device is disclosed in U.S. Pat. No. 2,495,308. Again the use of pliers type devices, which approach the bottle from the side rather than from the top, have a greater tendency to break the stopper due to the twisting force or torque imposed on the stopper by the device. This creates the same problems as stated above.

Another prior device that has been proposed for use in opening stoppered bottles is disclosed in the French Pat. No. 1,068,568. This device is said to be in the general form of a pair of pliers and includes two substantially identical members or limbs. A relatively large, heavy handle is perpendicularly formed on the upper end of each of the members. The lower ends of each include a separate piece that is attached by soldering. Each of the pieces includes a jaw comprising two sloped, clamping surfaces disposed generally at right angles to each other. Together the four clamping surfaces of these two jaws are said to define a reverse truncated pyramid. When the members are pivoted together, the jaws deform the protruding head of a bottle cork. In other words, the cork is clamped so tightly between the jaws, or more specifically between their clamping surfaces, that the cork is deformed and is thereafter removed by an application of a drawing, rotating movement.

There are, however, several drawbacks to the device described in this expired French patent. These have apparently prevented its acceptance in the marketplace. First, the device is designed for and can only be used with corks having a special configuration, that is, where the normally projecting portion of the corks have a generally square horizontal cross-sectional configuration or shape. Corks having such a square configuration are not in common usage today. This French patented device cannot, as a practical matter, be utilized with the stoppers that are used today and that have a truncated conical shape. Moreover the deformation of the cork as required by the French patented device, tends to cause corks to break before they come out of the bottles. Secondly, stoppers frequently get wet and slick, as for example, when the bottle has been refrigerated. This would result in slippage occurring between the stopper, particularly a plastic stopper, and the smooth clamping surfaces of the French patented device, regardless of the relative configurations of these surfaces and the device, unless extremely high clamping pressure is applied to the stopper by squeezing the device's handles. Such slippage can itself be potentially injurious to the person attempting to remove the stopper. Additionally this makes that device generally unsuitable for use by women and can again lead to the stopper being twisted or broken off in the bottle.

In summary, none of the above noted prior methods or devices are particularly safe or completely effective. Each has the potential of causing injuries, perhaps severe, to the person opening the bottle or to persons and property around where the bottle is being opened. Also such methods can result in broken fingernails and unwanted and undesirable spillage of the beverage. In addition, each requires significant hand, wrist and arm strength to affect the desired result. This has made it difficult for many women to open champagne and sparkling wine bottles. Accordingly, there has been a longstanding need for a safe and effective apparatus for easily removing stoppers from such bottles.

SUMMARY OF THE INVENTION

In principal aspect, the improved stopper removal apparatus of my invention provides a simple, facile, safe and effective means for removing corks and plastic stoppers from champagne and sparkling wine bottles. By the use of my improved apparatus, stoppers may be removed without the need for the application of excessive force or the risk of danger.

More specifically, my improved stopper removal apparatus includes two identical, integrally molded members. Each has an upper section terminating, at its upper end, in a unique, curved "T" or "Y" shaped handle that is designed to fit comfortably in, and conform to the shape of the human hand. Each also has a lower section that includes, at its lower end, an integral, generally semi-circular jaw having an inwardly facing, generally vertically disposed surface that conforms to the shape of the commonly used truncated conical stopper and that has a radius of curvature substantially the same as the radius or curvature of the stopper. The inwardly facing surfaces include a plurality of inwardly projecting, integral, sharp spiked prongs or tines that penetrate deeply into the stopper so as to provide a secure, firm, vice-like grip on the stopper, whether it is made of cork or a hard plastic material. The members are connected together, between their ends, so that the two inwardly facing surfaces of the jaws face each other and so that movement of the handles, in a scissors-like motion, causes the jaws to be moved between: an open position where the inwardly facing surfaces of the jaws are sufficiently spaced apart that the apparatus may be readily placed down over the top of a stopper; and a closed position where the inwardly facing surfaces are adjacent to the sides of the stopper. When in the closed position, the jaws almost, but not completely, encircle the stopper so that they do not and cannot deform the stopper. In addition, the jaws are designed such that they grip even the widest part of the stopper. Because the jaws are an integral molded part, the apparatus is highly resistant to breakage during normal usage. The height of the jaws are such that they may grip even the widest part of a plastic stopper and can accommodate the different height stoppers in use today. The upper and lower sections of the members are dimensioned so that the prongs or tines will tightly be embedded into the stopper even when only a moderate force has been applied by a person to the curved "T" or "Y" shaped handles. This enables a woman to easily use my apparatus.

An important advantage of my improved apparatus is that it permits a stopper to be removed with total control so as to protect the individual opening the bottle and to ensure that when the bottle is opened, the bubbles are, as desired, retained in the beverage. To accomplish the latter, the bottle is opened slowly, with a "psssssst", not a "pop". In other words, this controlled opening guarantees that the beverage stays in the bottle—and not all over the floor—until poured and that the person gets what he paid for—"bubbly".

Another advantage is the design or shape of the handles of my improved apparatus. The design conforms to the shape of the human hand, especially the smaller female hand. It is double purpose design. In contrast to the French patented device and the other prior methods discussed above, it importantly allows an individual either to hold the bottle stationary and pull the stopper out of the bottle or to hold the apparatus stationary and pull the bottle off of the stopper. The latter is the proper way of opening a bottle of champagne or sparkling wine.

Still another advantage of my improved apparatus is that it allows bottles to be opened without having to remove the metal retaining wire that secures the stopper. All one must do, in this respect, is twist the wire open sufficiently so that it will clear the top of the bottle.

Accordingly it is an object of my invention to provide an improved simple, safe, effective and relatively strong stopper removal apparatus for removing a cork or plastic stopper from a bottle containing a beverage under pressure. A related object of my invention is to provide an improved apparatus, as described, that will prevent the stopper from such a bottle from becoming a projectile and that thus will eliminate the potential for injuries previously associated with the removal of stoppers from such bottles. A still further object of my invention is to provide an improved apparatus, as described, that will effectively eliminate the breaking of a stopper in a bottle during the removal of the stopper and that affords an economical, commercially acceptable solution to the longstanding need in this art.

These and other objects, advantages and benefits of my invention will be apparent from the following description, including the accompanying drawing, of the preferred embodiment of my invention.

DESCRIPTION OF THE DRAWINGS

FIG. 1 is a partial perspective view of a typical cork or plastic stopper in the neck of a bottle containing a pressurized beverage.

FIG. 2 is a front view of one of the members of the preferred embodiment of the apparatus of my invention.

FIG. 3 is a side view of the preferred embodiment of the apparatus of my invention.

FIG. 4 is a partial top plan view that illustrates the semicircular jaws of the preferred embodiment of the apparatus of my invention.

FIG. 5 is a schematic view of the preferred embodiment of the apparatus of my invention, illustrating the apparatus in its open position and its closed position.

FIG. 6 is a side view of one of the members of the preferred embodiment of the apparatus of my invention.

DESCRIPTION OF THE PREFERRED EMBODIMENT

The improved apparatus of my present invention is generally indicated at 10. It is utilized for removing a cork or other type of plastic stopper 12 serving as a closure for glass bottles containing beverages under pressure such as champagne, sparkling wines, and the like.

As noted, FIG. 1 is a perspective view of a neck of a bottle 14 having the stopper 12 positioned therein. Generally, a wire mesh, not illustrated, is used to help hold the stopper 12 on the neck of the bottle 14 so as to insure against premature or accidental removal of the stopper 12 from the bottle.

Referring now to FIGS. 2, 3, 5 and 6, my apparatus 10 is comprised of two identical, integral, generally curved cast members 16. Preferably they are molded from zinc by use of a conventional molding process well known in the art. The members 16 intersect at a fulcrum point 18 and are coupled to each other, between their upper and lower ends, by means of a rivet 20. A washer 22 separates the two members 16. Specifically the washer 22 acts as a spacer between the members 16 and is held in position by the rivet 20. The coupling together of the two members 16 enables my apparatus 10 to be opened and closed by pulling apart or squeezing together the members 16, in a scissor-like manner, about the fulcrum point 18, as best illustrated in FIG. 5.

Each member 16 comprises a generally curved "T" or "Y" shaped handle 24, a vertical shaft 26, a jaw or base 28, a plurality of prongs or tines 32, and an aperture 34 that is positioned at the fulcrum point 18 and that is adapted to receive the rivet 20.

Each of the handles 24 is molded as an integral part of the shaft 26 and projects generally perpendicularly from the upper end of the shaft 26. The handle has a unique, smoothly curved, generally "T" or "Y" shape or design as best seen in FIGS. 2 and 3. This shape or design conforms to the shape of the human hand and is proportioned so that it may be easily and readily grasped, even by a smaller female hand. The shape or design has a two-fold purpose. It allows an individual to hold the bottle 14 stationary and pull the stopper 12 out of the bottle. Alternatively, the individual may hold the handles 26 stationary and pull the bottle 14 off of the stopper 12. The latter is the proper or appropriate way of opening a bottle of fine champagne or sparkling wine since it better preserves the bubbles—the carbonated gas—in the beverage. The shafts 26 are designed so that when the handles 24 are brought together in their closed position, the handles interfit together to, in effect, form a single handle. Similarly, when the handles 24 are in their closed position, the shafts 26 abut each other so as to prevent the application of further force to the jaws.

Each shaft 26 is curved adjacent the aperture 34 so that the upper end or section of the shaft, including the handle 24, is disposed on one side of a vertical plane including the center of the aperture, that is, the fulcrum point 18. As best seen in FIG. 6, the lower end or section of the shaft, including the jaw 28, is disposed on the other side of this vertical plane. The length of the upper end of the shaft, that is, the moment arm, between the handle 24 and the fulcrum point 18, is about twice as long as the length of the lower end of the shaft, that is, the moment arm between the fulcrum point 18 and the midpoint of the jaw 28. This permits the jaws 28 to exert an effective amount of force, up to 400 p.s.i., on a stopper when the handles 24 are only squeezed together with a moderate pressure, such as that which can be readily and typically exerted by a lady.

Each of the jaws 28 is molded as an integral part of the lower end of its shaft. Each has a semi-circular configuration as best illustrated in FIG. 4. Each also has a generally vertically disposed, inwardly facing surface 30 that conforms generally to the outer surface of the commonly used either truncated conical or conical shaped stopper 12 as shown in FIG. 3.

The surface 30 has a radius of curvature substantially the same as the radius of curvature of the stopper 12. The height of the surface 30 is greater than that of the commonly used stoppers, or more particularly, the height of the portion of the stopper that projects out of the bottle 14. The heights of the surfaces 30 permits them to reach the widest part of the stopper. Also the jaws 28 almost completely encircle the stopper 12 when the jaws are pressed together around the stopper. Specifically, the jaws form an arc of about 358 degrees around the stopper 12 before the handles 24 abut each other. This ensures that there will be virtually complete surface to surface contact between the surfaces 30 and the outer surface of the stopper 12, without deformation of the stopper, when the jaw 28 are squeezed together.

Three prongs or tines 32 are equally spaced on the inside of each of the semi-circular surfaces 30 of the jaws 28. These prongs or tines 32 lie in a generally horizontally disposed plane that is slightly below the horizontal center line of the surfaces 30. They are molded as integral parts of the surfaces 30 and have sharply pointed ends. They project inwardly a sufficient distance, preferably at least an eighth of an inch, from the surface 30 so 10 that the prongs or tines may deeply penetrate the stopper 12 when the jaws are moved to their closed position, such as shown in FIGS. 3 and 5. They are also of a shape, sufficient size, and strength that they will be embedded in the stopper 12, whether the stopper is made of cork or of a hard plastic material. Thus when the jaws 28 are moved to their closed position, the prongs or tines 32 will hold the stopper 12 in a strong, vice-like grip so that there will be no slippage between the stopper and the jaws even when the surface of the stopper is wet. However, more or less than three prongs or tines 32 per jaw may be used without departing from the spirit and scope of my invention, provided that when the handles 28 are squeezed together, the prongs or tines will have a tight, non-slip grip on the stopper 12.

As noted, the generally "T" or "Y" shape of the handles 24 afford two advantages. The first is that the curve of the handles 24 enables the apparatus 10 to rest comfortably and securely in a person's hand while enabling the person to firmly grasp the handles. The second is that the generally perpendicular alignment or disposition between the shafts 26 and the handles 24 provides the necessary torque that facilitates the loosening and removal of the stopper 12 with a minimum of physical strength.

Also as noted, the wire mesh, not illustrated, that is used to couple the stopper 12 to the neck of the bottle 12 is generally removed before the bottle is, in turn, opened. However, by using my apparatus 10, the mesh does not need to be completely removed from the bottle 14. Rather all that is required is to twist the wire mesh open enough so that it will clear the top of the bottle. My apparatus 10 can then be positioned over the entire stopper 12 by opening the two members 16 and positioning the jaws down over the top of the stopper 12 so that the curved portions 36 of the lower ends of the shafts 26 will rest on the top of the stopper 12. The two handles 24 are then squeezed together, in a scissor-like movement, causing the prongs or tines 32 to penetrate deeply into the stopper 12 and thereby creating a secure, non-slip grip therebetween. The person removing the stopper 12 from the bottle may hold the neck of the bottle 14, with one hand, while turning my apparatus 10 in a counter-clockwise direction, with the other hand, while pulling upwards, away from the bottle 14, with a constant force to safely and easily remove the stopper 12. Alternatively and preferably, the person grasps my apparatus 10 and holds it stationary. The bottle 14 is then pulled off the stopper 12. The prongs or tines 32, being embedded into the stopper 12, eliminate the possibility of the stopper becoming a projectile. Preferably, once the stopper starts to move, relative to the bottle, the stopper can be "cocked" to one side to slowly release the pressure in the bottle. Once the stopper 12 is clear of the bottle it is still held until the jaws 28 are again opened, and the stopper 12 is pulled off of the prongs or tines and thus released.

While there has been described and illustrated the preferred embodiment of my invention, it will be understood by those skilled in the art that various changes and modifications may be substituted for elements thereof without departing from the true scope of my invention. Further, many modifications may be made to adapt a particular situation or material to the teachings of my invention without departing from the central scope thereof. Therefore, it is intended that this invention not be limited to the particular embodiment disclosed as the best mode contemplated for carrying out my invention, but that the invention will include all embodiments falling within the scope of the appended claims.

I claim:

1. An improved stopper removal apparatus for the facile and safe removal of a stopper that is being used as a closure for a glass bottle containing a beverage under pressure, such as champagne and sparkling wines, where the portion of the stopper, projecting beyond the end of the bottle has a generally conical outer surface, the improved apparatus comprising:

a pair of substantially identical members that each include a vertical shaft, an upper end and a lower end, that are connected together at a fulcrum point located between their upper and lower ends, that each have a handle molded as an integral part of its upper end, and that each have a jaw molded as an integral part of its lower end;

each of the handles projecting generally perpendicularly from the vertical shaft and having a generally curved "T" or "Y" shape that conforms to the shape of the human hand and that is proportioned so that it may easily and readily be grasped even by a smaller female hand;

each of the vertical shafts being curved so that its upper end is disposed on one side of a vertical plane, including the fulcrum point, and so that its lower end is disposed on the other side of the vertical plane;

each of the jaws including a semi-circular inwardly facing surface that has a generally truncated, conical shape and that has a radius of curvature substantially the same as the radius of curvature of the outer surface of the stopper to be removed; the inwardly facing surfaces of the jaws having a plurality of evenly spaced, sharply pointed prongs that are molded as an integral part of the inwardly facing surfaces, that project inwardly from the inwardly facing surfaces and that are adapted to deeply penetrate into the stopper when the jaws are moved, in response to movement of the handles, in a scissor-like manner about the fulcrum point, from an open position where the jaws are spaced apart and may be positioned down over the top of the stopper to be removed to a closed position where the jaws substantially encircle the stopper, without deforming it, and the prongs are embedded in the stopper so that the stopper is securely and firmly gripped between and by the jaws.

2. The improved apparatus of claim 1 wherein the portions of the lower ends of the vertical shafts, adjacent to the jaws, rest on the top of the stopper when the jaws are moved to their closed position.

3. The improved apparatus of claim 1 including means for preventing the jaws from abutting each other when they are moved to their closed position.

4. The improved apparatus of claim 1 wherein the vertical height of the jaws is at least the same as the height of the portion of the stopper that projects out beyond the end of the bottle.

5. The improved apparatus of claim 1 wherein the members are connected together by a rivet; wherein the stopper is a cork; and wherein the members are made from a moldable metal.

* * * * *